US007075408B2

(12) United States Patent
Mihara et al.

(10) Patent No.: US 7,075,408 B2
(45) Date of Patent: Jul. 11, 2006

(54) LAMINATE-TYPE POSITIVE TEMPERATURE COEFFICIENT THERMISTOR

(75) Inventors: Kenjiro Mihara, Yokaichi (JP); Hideaki Niimi, Hikone (JP)

(73) Assignee: Murata Manufacturing Co, Ltd., Kyoto (JP)

( * ) Notice: Subject to any disclaimer, the term of this patent is extended or adjusted under 35 U.S.C. 154(b) by 0 days.

(21) Appl. No.: 10/801,152

(22) Filed: Mar. 16, 2004

(65) Prior Publication Data

US 2004/0189437 A1 Sep. 30, 2004

(30) Foreign Application Priority Data

Mar. 26, 2003 (JP) ..... 2003-084406
Feb. 16, 2004 (JP) ..... 2004-037952

(51) Int. Cl.
*H01C 7/10* (2006.01)

(52) U.S. Cl. ..... 338/22 R; 338/204; 338/328; 338/332

(58) Field of Classification Search ..... 338/22 R, 338/22 SD, 99, 100, 13, 20, 23, 204, 205, 338/322, 328
See application file for complete search history.

(56) References Cited

U.S. PATENT DOCUMENTS 4,542,365 A * 9/1985 McTavish et al. ..... 338/20
5,777,541 A * 7/1998 Vekeman ..... 338/22 R
6,259,349 B1 * 7/2001 Strumpler et al. ..... 338/22 R
6,311,390 B1 * 11/2001 Abe et al. ..... 29/612
6,429,533 B1 * 8/2002 Li et al. ..... 257/783
6,556,123 B1 * 4/2003 Iwao et al. ..... 338/22 R
6,593,844 B1 * 7/2003 Iwao et al. ..... 338/22 R
2002/0125982 A1 * 9/2002 Swensen et al. ..... 338/22 R
2003/0001261 A1 * 1/2003 Ueda et al. ..... 338/22 R
2004/0090304 A1 * 5/2004 Hetherton et al. ..... 338/22 R
2004/0252006 A1 * 12/2004 Kojima et al. ..... 338/22 R

FOREIGN PATENT DOCUMENTS

JP 3-208301 * 9/1991 ..... 338/22 R
JP 05-047508 2/1993
JP 6-61014 * 3/1994 ..... 338/22 R
JP 6-208903 * 7/1994 ..... 338/22 SD
JP 08-153606 6/1996

OTHER PUBLICATIONS 06-208903 English machine translation to Mihara et al. (Jul. 1994).*
06-061014 English machine translation to Fukuyama et al. (Mar. 1994).*
Official Communication issued in the corresponding Korean Application No. 10-2004-0020422, dated Sep. 15, 2005. (full English translation).

* cited by examiner

*Primary Examiner*—Tu Hoang
(74) *Attorney, Agent, or Firm*—Keating & Bennett, LLP

(57) ABSTRACT

A positive temperature coefficient thermistor has a non-heating portion which is not heated when a voltage is applied between first and second internal electrodes. The non-heating portion is provided in the approximate center of the positive temperature coefficient thermistor and is arranged to extend along a direction that is substantially perpendicular to a lamination direction of the positive temperature coefficient thermistor. The non-heating portion is arranged at least in the approximate center in the lamination direction of the portion of the laminate where the first and the second internal electrodes are arranged. Thus, a hot spot is reliably prevented from occurring inside the laminate when voltage is applied. As a result, the withstand voltage property is greatly improved. The non-heating portion may include a cavity provided in at least one thermistor layer or an opening or cut portion provided in the internal electrode.

13 Claims, 8 Drawing Sheets

LAMINATE-TYPE POSITIVE TEMPERATURE COEFFICIENT THERMISTOR

BACKGROUND OF THE INVENTION

1. Field of the Invention

The present invention relates to a positive temperature coefficient thermistor and more particularly to a laminate-type positive temperature coefficient thermistor having a greatly improved withstand voltage property.

2. Description of the Related Art

Generally, laminate-type positive temperature coefficient thermistors have the following structure (for example, see Japanese Unexamined Patent Application Publication No. 5-47508).

In particular, a laminate-type positive temperature coefficient thermistor includes a substantially rectangular laminate with a positive resistance-temperature coefficient. The laminate has a plurality of laminated thermistor layers, and first and second external electrodes formed on the outer surface, that is, on the first and second opposed end surfaces of the laminate.

Moreover, a plurality of first and second internal electrodes are uniformly formed on predetermined interfaces between the thermistor layers inside the laminate. The first and second internal electrodes are electrically connected to the first and second external electrodes. The first and second internal electrodes are alternately arranged in the lamination direction such that a portion of the first internal electrodes and a portion of the second internal electrodes overlap each other.

For positive temperature coefficient thermistors, it is necessary to have a sufficient withstand voltage property. Referring to the withstand voltage properties of the laminate-type positive temperature coefficient thermistors having the above-described structure, a breakdown occurs in the center of the laminate. Specifically, in some cases, the breakdown occurs in the center in the lamination direction of the portion where the first and second internal electrodes are arranged and in the center in a direction that is substantially perpendicular to the lamination direction of the portion of the laminate where the first and second internal electrode overlap each other. The breakdown arises due to the heat-dissolution of a semiconductor ceramic constituting the thermistor layers. In particular, for example, the laminate is heated when a voltage is applied to the laminate-type positive temperature coefficient thermistor for evaluation of the withstand voltage property. The generated heat is stored in the center of the laminate. Thus, the center of the laminate becomes a hot-spot. As a result, the "explosion of heat" occurs, so that the semiconductor ceramic constituting the thermistor layers is heat-dissolved. Probably, the heat-dissolution causes the above-described breakdown in the center of the laminate.

SUMMARY OF THE INVENTION

In order to overcome the problems described above, preferred embodiments of the present invention provide a laminate-type positive temperature coefficient thermistor having a greatly improved withstand voltage property without experiencing breakdowns in the laminate.

According to a preferred embodiment of the present invention, a positive temperature coefficient thermistor includes a laminate including a plurality of thermistor layers and having a positive resistance temperature coefficient, first and second external electrodes located at different positions on the outer surface of the laminate, and a plurality of first internal electrodes and a plurality of second internal electrodes arranged so as to extend along predetermined interfaces between the plurality of thermistor layers inside of the laminate, and so as to be electrically connected to the first external electrode and the second external electrode, respectively, the first internal electrodes and the second internal electrodes being arranged alternately in the lamination direction so that a portion of the first internal electrodes and a portion of the second internal electrodes overlap each other while sandwiching the thermistor layers therebetween, and a non-heating portion which is not heated when voltage is applied between the first and second internal electrodes, the non-heating portion being located in an approximate center along a direction that is substantially perpendicular to the lamination direction of the portion of the laminate where the first and second internal electrodes are arranged and at least in an approximate center in the lamination direction thereof. The approximate center of the portion of the laminate will act as a hot spot when voltage is applied.

Preferably, a cavity positioned in the approximate center along a direction that is substantially perpendicular to the lamination direction of the portion of the laminate where the first and second internal electrodes overlap each other is provided in at least one of the thermistor layers. Preferably, the cavity is positioned at least in the approximate center in the lamination direction of the portion of the laminate where the first and second internal electrodes are arranged. The cavity functions as a non-heating portion. Preferably, the cavity is formed so as to pass through the thermistor layer in the thickness direction. Also, preferably, the internal electrode positioned on one end side of the cavity is provided with an opening connected to the cavity.

According to another preferred embodiment of the present invention, a positive temperature coefficient thermistor includes a laminate including plural thermistor layers and having a positive resistance temperature coefficient, first and second external electrodes disposed in different positions on the outer surface of the laminate, and plural first internal electrodes and plural second internal electrodes arranged to extend along predetermined interfaces between the plural thermistor layers inside the laminate and so as to be electrically connected to the first external electrode and the second external electrode, respectively, the first internal electrodes and the second internal electrodes being arranged alternately in the lamination direction so that a portion of the first internal electrodes and a portion of the second internal electrodes overlap each other while sandwiching the thermistor layers therebetween, at least one of the first and second internal electrodes which is positioned at least in an approximate center in the lamination direction of the portion of the laminate where the first and second internal electrodes are arranged to include a portion thereof that is not provided with the electrode, the portion not provided with the electrode being positioned at least in the approximate center in the lamination direction of the portion of the laminate where the first and second internal electrodes overlap each other. The portion not provided with the electrode functions as a non-heating portion.

Preferably, the portion not provided with the electrode is formed of an opening provided in the internal electrode. Also, preferably, the portion not provided with the electrode is formed of a cut portion provided in the internal electrode.

The portion not provided with the electrode may be formed in all of the first electrodes or all of the second internal electrodes, or may be formed in all of the first electrodes and the second internal electrodes.

According to various preferred embodiments of the present invention, a hot spot can be prevented from occurring inside the laminate included in the positive temperature coefficient thermistor. Thus, the withstand voltage property is greatly improved.

According to various preferred embodiments of the present invention, preferably, the cavity is formed so as to pass through the thermistor layer in the thickness direction, or the opening is formed in the internal electrode positioned on one end side of the cavity so as to be connected to the cavity. In this case, the cavity can be easily formed. Thus, the positive temperature coefficient thermistor has a structure suitable for mass-production.

Other features, elements, characteristics and advantages of the present invention will become more apparent from the following detailed description of preferred embodiments thereof with reference to the attached drawings.

DETAILED DESCRIPTION OF PREFERRED EMBODIMENTS

Figure 1:
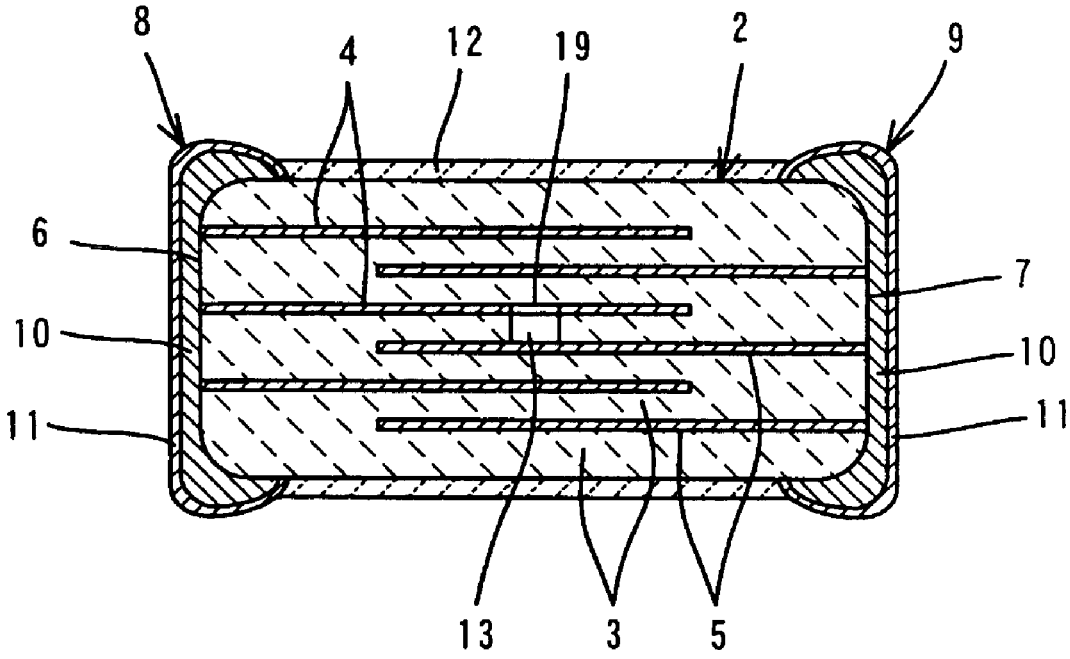
FIG. 1 is a cross-sectional view of a positive temperature coefficient thermistor according to a first preferred embodiment of the present invention.

FIG. 1 is a cross-sectional view of a positive temperature coefficient thermistor 1 according to a first preferred embodiment of the present invention.

The positive temperature coefficient thermistor 1 includes a laminate 2 having a substantially rectangular shape as the main element of a device. Ordinarily, the edges and ridges of the substantially rectangular laminate 2 are rounded by abrading with a barrel or the like. The laminate 2 has a positive resistance temperature coefficient. For example, the laminate preferably includes a plurality of laminated thermistor layers 3, e.g., made of a $BaTiO_3$ type ceramic or other suitable material.

Plural first internal electrodes 4 and plural second internal electrodes 5 are located on predetermined interfaces between the plural thermistor layers 3 inside the laminate 2. The first and second internal electrodes 4 and 5 are arranged alternately in the lamination direction such that a portion of the internal electrodes 4 and a portion of the internal electrodes 5 overlap each other. The internal electrodes 4 and 5 preferably include, e.g., nickel as an electroconductive component.

A first external electrode 8 and a second external electrode 9 are disposed on the outer surfaces, that is, the first and second opposed end surfaces 6 and 7 of the laminate 2, respectively. The first and second external electrodes 8 and 9 are electrically connected to the first and second internal electrodes 4 and 5, respectively. Each of the first and second external electrodes 8 and 9 preferably includes an ohmic electrode layer 10 as an undercoat layer which can ohmic-contact the internal electrode 4 or 5, and a plating layer 11 made of solder or other suitable material disposed on the ohmic electrode layer 10. The ohmic electrode layer 10 is preferably formed, e.g., by sputtering, and includes a Cr layer disposed on each of the end surfaces 6 and 7 of the laminate 2, an Ni—Cu layer disposed thereon, and an Ag layer disposed thereon. The plating layer 11 may be an Ni-plating, an Sn plating layer, or other suitable material plating, instead of the solder plating as described above. Ordinarily, the plating layer 11 is formed by electro-plating.

Moreover, a glass coat 12 may be formed on the portions of the outer surface of the laminate 2 which are not covered with the external electrodes 8 and 9. In the case where a firing process for forming the laminate 2 is carried out in a reducing atmosphere, the heat-treatment for re-oxidation is carried out after the firing. The heat-treatment for formation of the glass coat 12 may be carried out simultaneously in the above-described reoxidation process.

The positive temperature coefficient thermistor according to the above-described first preferred embodiment of the present invention has the following unique features.

Specifically, a cavity is formed in at least one thermistor layer 3 in the approximate center in a direction that is substantially perpendicular to the lamination direction of the portion of the laminate 2 where the first and second internal electrodes 4 and 5 overlap each other. In particular, the cavity 13 is formed in at least one thermistor layer in the approximate center in the longitudinal and width directions of the portion of the laminate 2 where the internal electrodes 4 and 6 overlap each other. Moreover, the cavity 13 is positioned at least in the approximate center in the lamination direction of the portion of the laminate 2 where the first and second internal electrodes 4 and 5 are arranged. This cavity 13 functions as a non-heating portion.

Figure 2A:
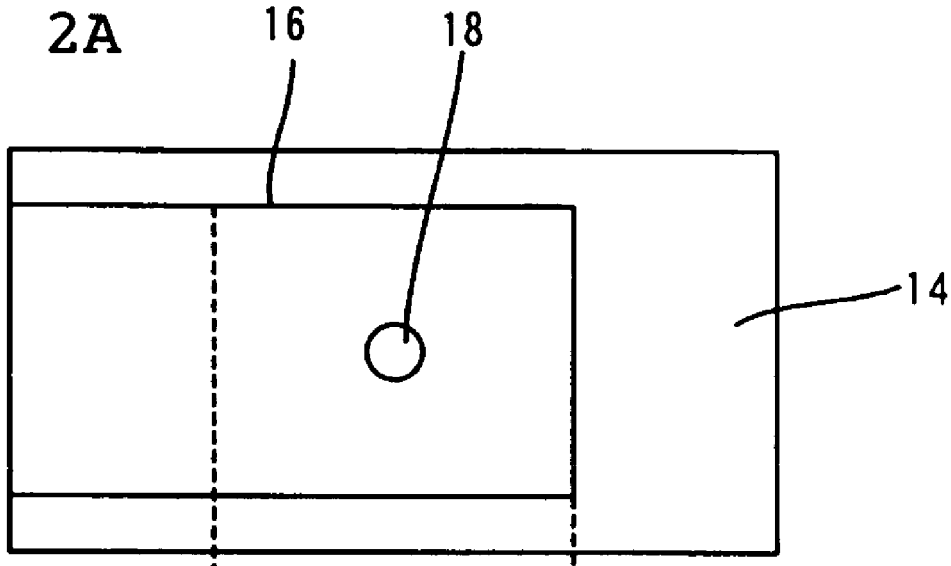
FIGS. 2A and 2B are plan views of green sheets for forming thermistor layers which are prepared for production of the laminate shown in FIG. 1.
Figure 2B:
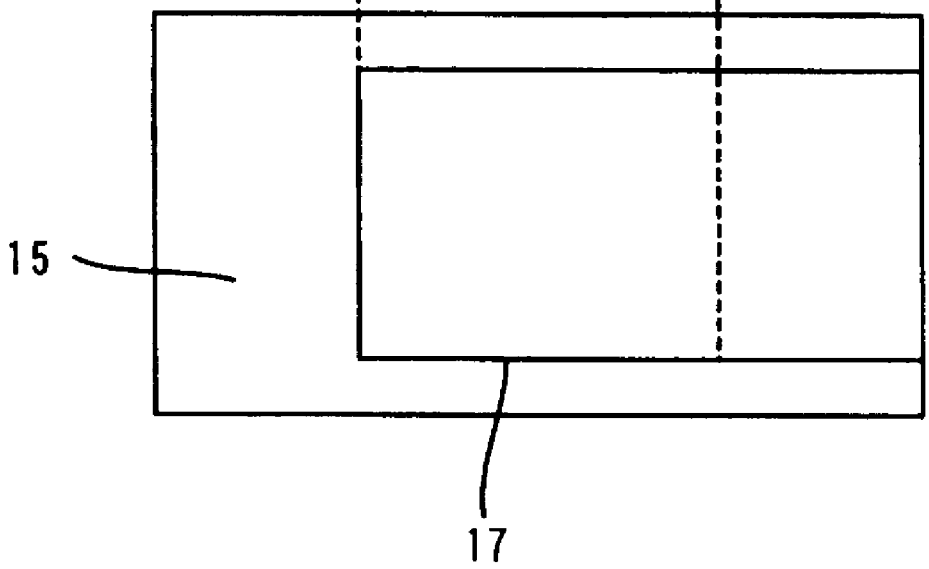

To form the above-described cavity 13, for example, a method illustrated in FIGS. 2A and 2B may be applied. FIGS. 2A and 2B are plan views of typical green sheets 4 and 5 for forming the thermistor layers 3. That is, the green sheets 14 and 15 are prepared for formation of the laminate 2.

As seen in FIGS. 2A and 2B, electroconductive paste is applied onto the green sheets 14 and 15 by screen-printing or other suitable process. Thus, electroconductive paste films 16 and 17 for forming the first and second internal electrodes 4 and 5 are produced.

As shown in FIG. 2A, a perforation 18 for forming the cavity 13 is provided in the green sheet 14. From the standpoint of mass-production, preferably, the perforation 18 is formed in such a manner that the electroconductive paste film 16 is also perforated after the formation of the electroconductive paste film 16.

If the perforation 18 is formed before the formation of the electroconductive paste film 16, and then, the electroconductive paste film 16 is formed, the conductive paste flows into the perforation 18. As a result, the first and second internal electrodes 4 and 5 will be undesirably electrically connected to each other. The electroconductive paste may be applied onto the outer peripheral portion of the perforation 18 with a predetermined gap being provided between the paste and the perforation 18. However, in this case, other problems, e.g., troublesome positioning or the like, may occur.

Also, the following may be supposed; the perforation 18 is formed in the green sheet 14 on which the electroconductive paste film 16 is not formed, and the electroconductive paste film 16 is formed on a green sheet (not shown) positioned directly above the green sheet 14. In this case, the electroconductive paste films 16 and 17 are formed on the opposite sides of the green sheet 14. Accordingly, problems occur in that the positioning of the electroconductive paste films 16 and 17 is tedious.

Typically, the perforation 18 for forming the cavity 13 is formed by a laser, by punching or other suitable process. The cavity 13 is not restricted to being formed by the above-mentioned methods.

Plural green sheets including the green sheets 14 and 15 shown in FIGS. 2A and 2B are laminated to form the laminate 2. Accordingly, the cavity 13 converted from the perforation 18 passes through the relevant thermistor layer 3 in the thickness direction. Also, the perforation 18 is formed so as to pass through the electroconductive paste film 16. Thus, the first internal electrode 4 positioned on one end side of the cavity 13 is provided with an opening 19 connected to the cavity 13.

The cavity 13 shown in FIG. 1 passes through the relevant internal electrode 4. It is to be noted that the cavity 13 may be arranged so as not to pass through the internal electrode 4 in the thickness direction, if the mass-production is not considered.

The cavity 13 may be formed in plural thermistor layers 3. In particular, for example, the cavity 13 may be formed so as to have a vertical column shape i.e., to pass through the plural thermistor layers 3 in the lamination direction in the portion of the laminate 2 where the first and second internal electrodes are arranged, provided that the cavity 13 is positioned in the approximate center along a direction that is substantially perpendicular to the lamination direction of the portion of the laminate 2 where the internal electrodes 4 and 5 overlap each other and at least in the approximate center in the lamination direction of the portion of the laminate 2 where the first and second internal electrodes are arranged.

Plural cavities 13 may be formed in one thermistor layer 3, provided that the plural cavities 13 are formed so as to be concentrated in the approximate center along the direction that is substantially perpendicular to the lamination direction of the laminate 2.

As seen in the shape of the perforation 18 of FIG. 2A, the cavity 13 may be substantially circular in section. Moreover, the cross-section of the cavity 13 may be substantially triangular, substantially rectangular, substantially polygonal, substantially elliptic, or may have a star shape or another appropriate cross-sectional shape.

The first and second internal electrodes 4 and 5 are preferably arranged equally with each other in the laminate 2 as shown in FIG. 1. Accordingly, the cavity 13 is positioned in the approximate center of the laminate 2. If the first and second internal electrodes 4 and 5 are arranged unequally with each other in the laminate 2, it is not necessary to position the cavity 13 in the approximate center of the laminate 2. Anyway, it is preferable that the cavity 13 is positioned in the approximate center along the direction that is substantially perpendicular to the lamination direction of the portion of the laminate where the first and second internal electrodes 4 and 5 overlap each other and at least in the approximate center in the lamination direction of the portion of the laminate 2 where the first and second internal electrodes 4 and 5 are arranged.

As described above, according to the first preferred embodiment, the cavity 13 which functions as a non-heating portion is provided. Thus, the concentration of heat can be reduced, and thereby, the withstand voltage property can be enhanced. As a result, the heat breakdown can be prevented. From the standpoint of enhancement of the withstand voltage property, desirably, the cavity 13 has a large size. However, the size of the cavity 13 is determined considering the size of the laminate 2, the electric resistance required for the positive temperature coefficient thermistor 1, the mechanical strength required for the laminate 2, and so forth.

Figure 3:
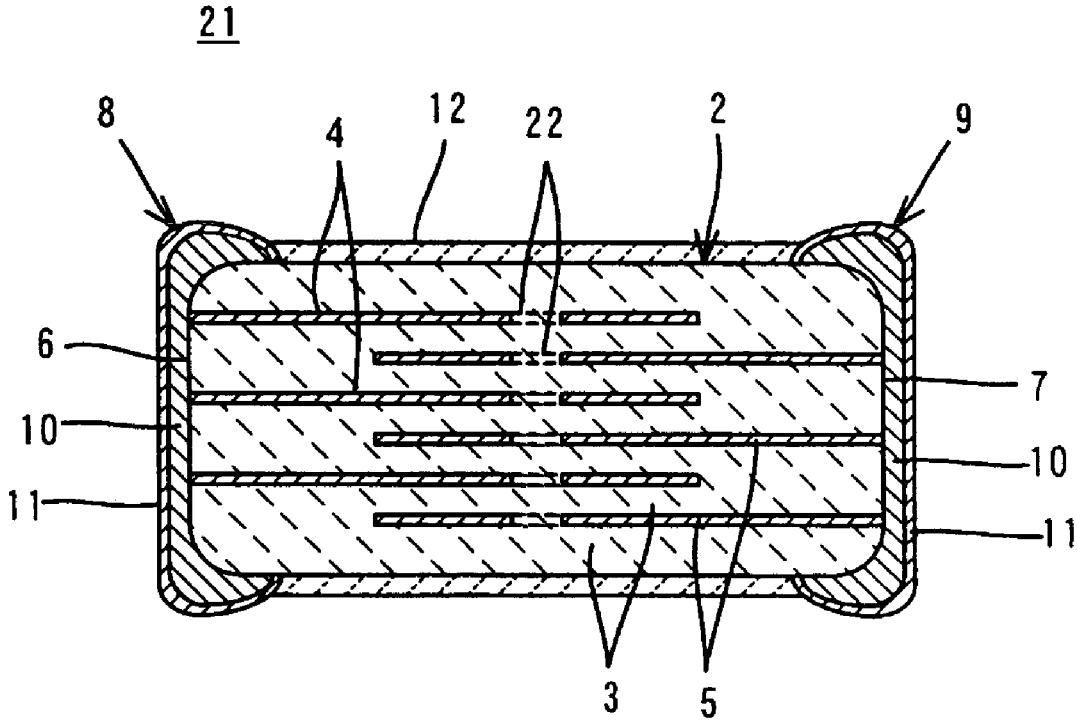
FIG. 3 is a cross-sectional view of a positive temperature coefficient thermistor according to a second preferred embodiment of the present invention.

FIG. 3 is a cross-sectional view of a positive temperature coefficient thermistor 21 according to a second preferred embodiment of the present invention. The positive temperature coefficient thermistor 21 shown in FIG. 3 has many elements which are equivalent to those of the positive temperature coefficient thermistor 1 of FIG. 1. Thus, in FIG. 2, the elements equivalent to those of FIG. 1 are designated by the same reference numerals. The description is not repeated.

The positive temperature coefficient thermistor 21 according to the second preferred embodiment has the following unique features.

The first and second internal electrodes 4 and 5 are provided with openings 22, respectively. The openings 22 are positioned in the approximate center along a direction that is substantially perpendicular to the lamination direction of the portion of the laminate 2 where the first and second internal electrodes 4 and 5 overlap each other, that is, in the approximate center in the longitudinal and width directions of the portion of the laminate 2 where the first and second internal electrodes 4 and 5 overlap each other. The openings 22 are converted to the portions not provided with the electrode. The openings 22 function as non-heating portions.

Figure 4A:
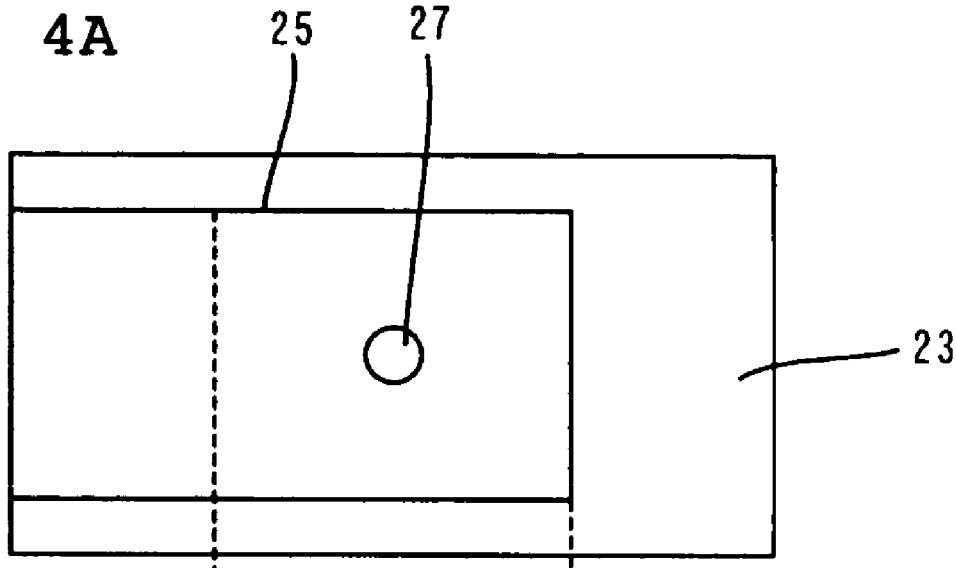
FIGS. 4A and 4B are plan views of green sheets for forming thermistor layers which are prepared for production of the laminate shown in FIG. 3.
Figure 4B:
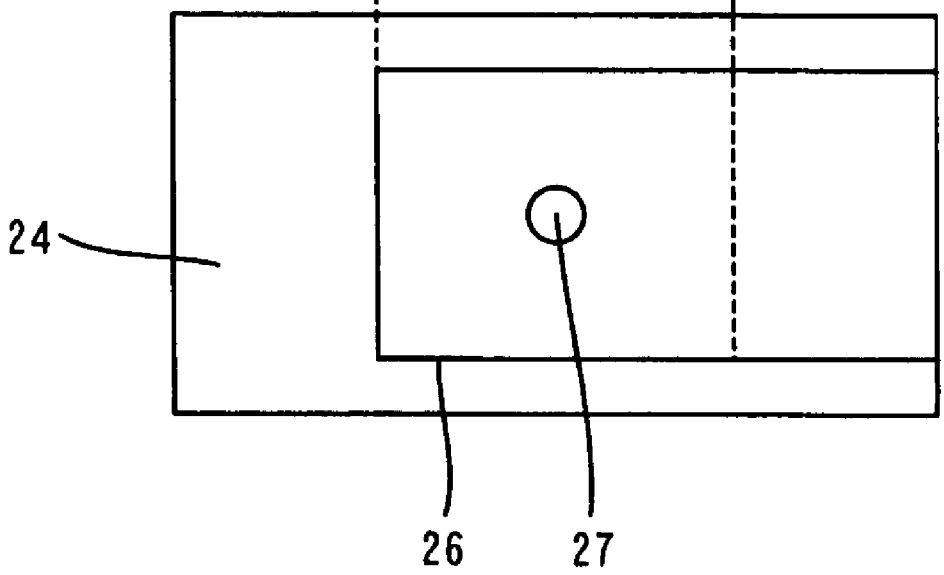

To form the above-described openings 22, for example, a method illustrated in FIGS. 4A and 4B may be applied. FIGS. 4A and 4B are plan views of typical green sheets 23 and 24 for forming the thermistor layers 3. That is, the green sheets 23 and 24 are prepared for formation of the laminate 2.

As seen in FIGS. 4A and 4B, electroconductive paste is applied onto the green sheets 23 and 24 by screen-printing or other suitable process. Thus, electroconductive paste films 25 and 26 for forming the first and second internal electrodes 4 and 5 are provided. When the electroconductive paste films 26 and 27 are formed by printing, areas 27 are formed in which the electroconductive paste is not applied. The areas 27 are provided to form the openings 22.

To provide the laminate 2 shown in FIG. 3, the plural green sheets 23 and 24 as shown in FIGS. 4A and 4B are alternately laminated. Moreover, green sheets for protection on which electroconductive paste films are not formed are laminated to the upper and lower sides of the formed laminate.

In the positive temperature coefficient thermistor 21 shown in FIG. 3, the openings 22 are provided for all of the first and second internal electrodes 4 and 5. However, such openings 22 may be provided for the first internal electrodes 4 only or for the second internal electrodes 5 only. Moreover, to avoid the formation of a hot spot, the openings 22 may be provided in at least one of the internal electrodes 4 and/or the internal electrodes 5 which are positioned at least in the approximate center in the lamination direction of the portion of the laminate 2 where the internal electrodes 4 and the internal electrodes 5 are arranged.

Moreover, plural openings 22 may be formed for each internal electrode 4 or internal electrode 5, provided that the openings 22 are positioned so as to be concentrated in the approximate center along the direction that is substantially perpendicular to the lamination direction of the portion of the laminate 2.

As seen in the shapes of the areas 27 shown in FIGS. 4A and 4B, the shapes of the openings 22 are preferably substantially circular in section. Moreover, the cross-sections of the openings 22 may be substantially triangular, substantially rectangular, substantially polygonal, substantially elliptic, or may have a star shape or another appropriate shape.

As described above, according to the second preferred embodiment, the openings 22 are provided, so that the concentration of heat can be reduced, as in the first preferred embodiment. Thereby, the withstand voltage property can be enhanced. Thus, the heat breakdown can be prevented. From the standpoint of enhancement of the withstand voltage property, desirably, the openings 22 have a large size. However, the sizes of the openings 22 are determined considering the size of the laminate 2, the electric resistance required for the positive temperature coefficient thermistor 21, the current-capacity required for the portion of the first and second internal electrodes 4 and 5 excluding the openings 22.

Moreover, according to the second preferred embodiment, in contrast to the first preferred embodiment, the positive temperature coefficient thermistor 21 is advantageous in that the thermistor 21 does not encounter the problem of the reduction of the mechanical strength of the laminate 2 which will occur due to the cavity 13.

Figure 5:
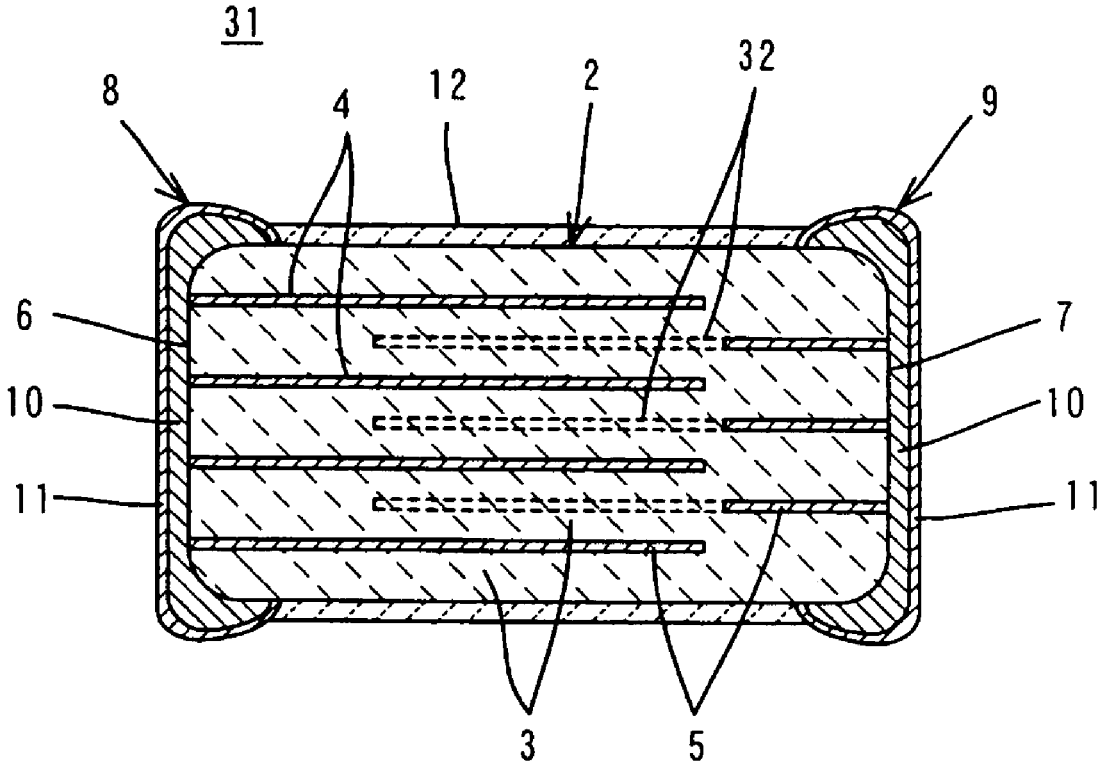
FIG. 5 is a cross-sectional view of a positive temperature coefficient thermistor according to a third preferred embodiment of the present invention.

FIG. 5 is a cross-sectional view of a positive temperature coefficient thermistor 31 according to a third preferred embodiment of the present invention. The positive temperature coefficient thermistor 31 shown in FIG. 3 preferably includes many elements that are equivalent to those of the positive temperature coefficient thermistors 1 and 2 of FIGS. 1 and 3. Thus, in FIG. 3, the elements equivalent to those of FIGS. 1 and 3 are designated by the same reference numerals. The description of these common elements is not repeated.

The positive temperature coefficient thermistor 31 according to the third preferred embodiment has the following features.

The second internal electrodes 5 are provided with cut portions 32, respectively. The cut portions 32 are positioned in the approximate center along a direction that is substantially perpendicular to the lamination direction of the portion of the laminate 2 where the first and second internal electrodes 4 and 5 overlap each other, that is, in the approximate center in the longitudinal and width directions of the portion of the laminate 2 where the first and second internal electrodes 4 and 5 overlap each other. The cut portions 32 are converted to the portions not provided with the electrode. The cut portions 32 function as non-heating portions.

Figure 6A:
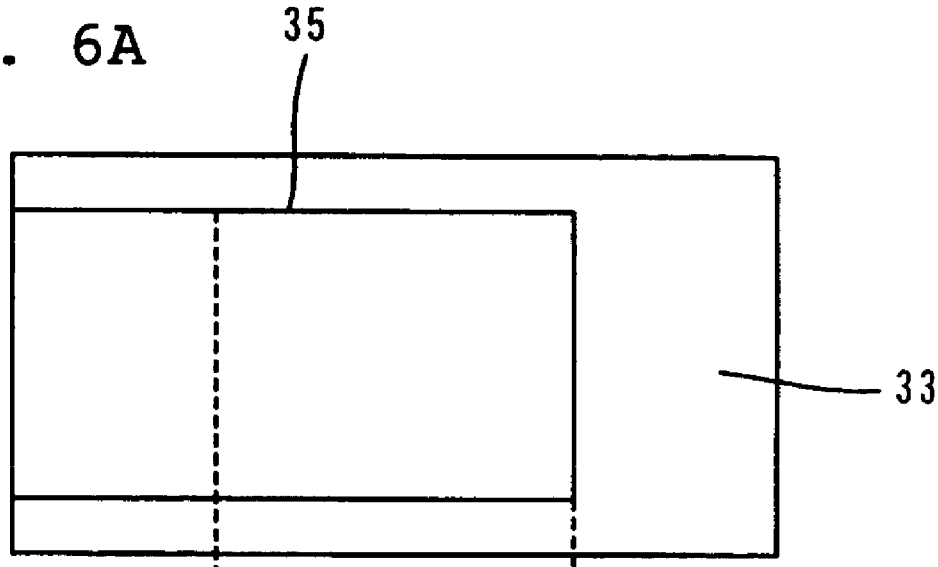
FIGS. 6A and 6B are plan views of green sheets for forming thermistor layers which are prepared for production of the laminate shown in FIG. 5.
Figure 6B:
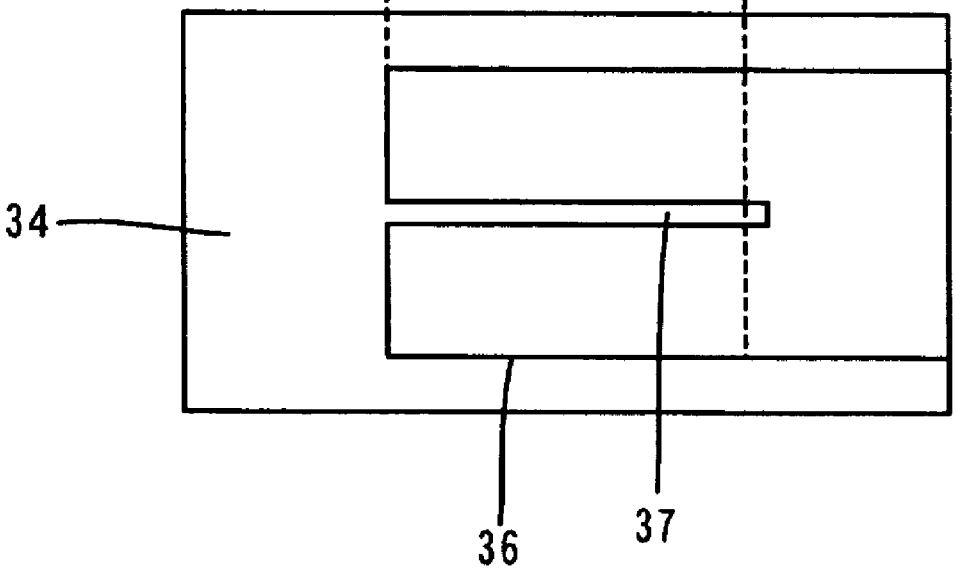

To form the above-described cut portions 32, for example, a method which is described with reference to FIGS. 6A and 6B is preferably used. FIGS. 6A and 6B are plan views of typical green sheets 33 and 34 for forming the thermistor layers 3 of the laminate 2.

As seen in FIGS. 6A and 6B, electroconductive paste is applied onto the green sheets 23 and 24 by screen-printing or other suitable process. Thus, electroconductive paste films 35 and 36 for forming the first and second internal electrodes 4 and 5 are provided. When the electroconductive paste films 35 of these paste films are formed by printing, areas 37 in which the electroconductive paste is not applied are formed. The areas 37 are provided to form the cut portions 32.

To provide the laminate 2 shown in FIG. 5, plural green sheets 33 and 34 as shown in FIGS. 6A and 6B are alternately laminated, and moreover, green sheets for protection on which electroconductive paste films are not provided are laminated to the upper and lower sides of the formed laminate.

In the positive temperature coefficient thermistor 31 shown in FIG. 5, the cut portions 32 are provided for all of the second internal electrodes 5. However, the cut portions 32 may be provided for all of the internal electrodes 4 or for all of the internal electrodes 4 and 5. For the purpose of avoiding the formation of a hot spot, it is satisfactory to provide the cut portions 32 for at least one of the internal electrodes 4 and/or 5 at least in the approximate center in the lamination direction of the portion of the laminate 2 where the first and second internal electrodes 4 and 5 are arranged.

Plural cut portions 32 for each of the internal electrodes 4 and 5 may be formed, provided that the plural cut portions 32 are distributed so as to be concentrated in the approximate center along a direction that is substantially perpendicular to the lamination direction of the laminate 2.

Preferably, the cut portions 32 are formed so as not to reach the second end surface 7 of the laminate 2 as seen in this preferred embodiment. According to this configuration, the internal electrodes 5 can be electrically connected to the external electrode 9 with high stability.

As described above, according to the third preferred embodiment, the cut portions 32 are provided, so that the concentration of heat can be reduced as in the first and second preferred embodiments. Especially, according to the third preferred embodiment, the cut portions 32 are extended in the approximate central portions of the internal electrodes 5 so as to divide the internal electrodes 5 into two portions, respectively. Thus, the internal electrodes 5, i.e., the heating portions can be divided into two portions, respectively. The quantity of heat generated by each heating portion is relatively small. Therefore, the heating in the approximate center of the laminate 2 can be relaxed. Thus, this reliably prevents a hot spot from being formed inside the laminate 2. The withstand voltage property is thus greatly improved so as to prevent the heat breakdown of the thermistor 1.

From the standpoint of enhancing the withstand voltage property, preferably, the cut portions 32 have a large width. However, the sizes of the cut portions 32 are determined considering the size of the laminate 2, the electric resistance required for the positive temperature coefficient thermistor 31, and the current-capacity required for the thermistor 31 in the area of the first and second internal electrodes 4 and 5 excluding the cut portions 32.

Moreover, advantageously, the positive temperature coefficient thermistor of the third preferred embodiment does not encounter such a problem as the reduction of the mechanical strength of the laminate 2, which occurs due to the cavities 13 as in the first preferred embodiment.

Figure 7A:
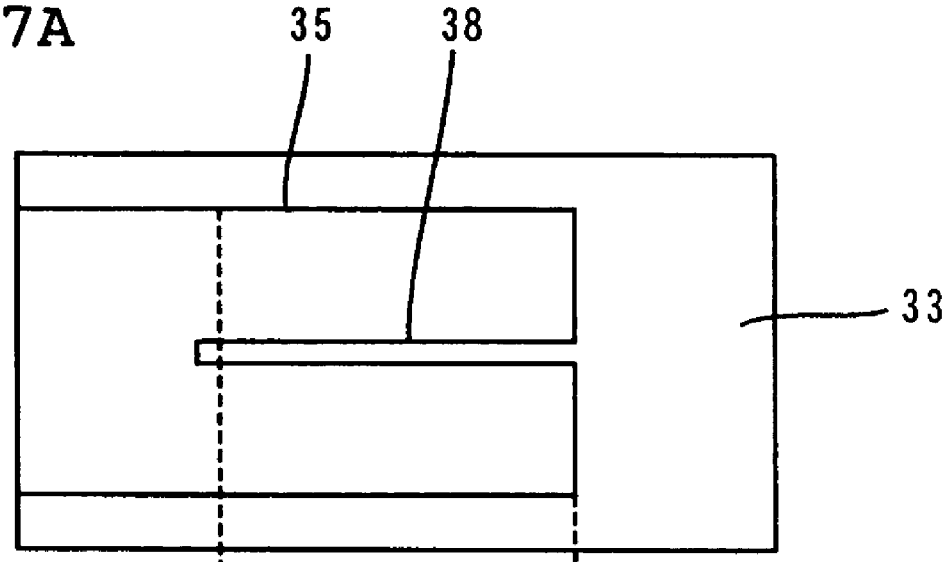
FIGS. 7A and 7B illustrate a fourth preferred embodiment of the present invention and corresponds to FIG. 6.
Figure 7B:
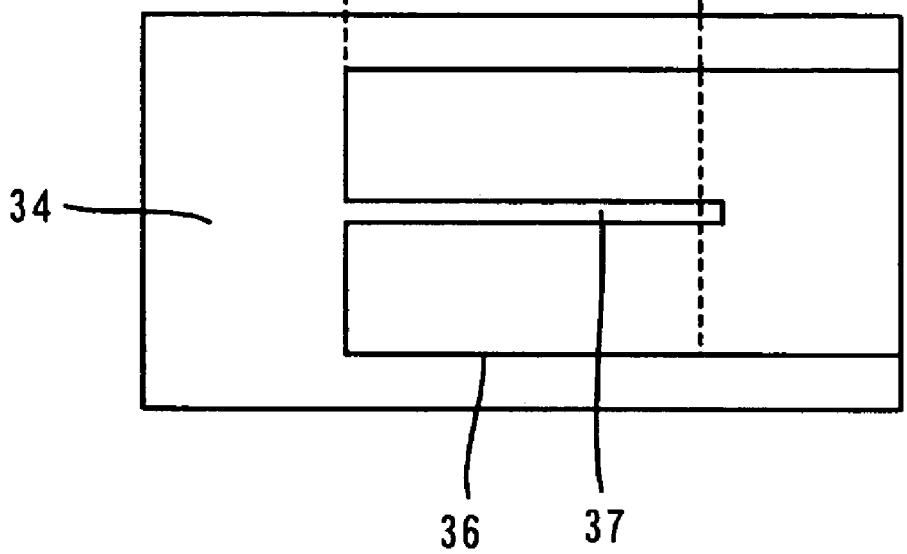

FIGS. 7A and 7B illustrate a fourth preferred embodiment of the present invention, and correspond to FIGS. 6A and 6B. In FIGS. 7A and 7B, the elements equivalent to those shown in FIGS. 6A and 6B are designated by the same reference numerals. The description of the common elements is not repeated.

According to the fourth preferred embodiment, characteristically, cut portions are provided for not only the second internal electrodes 5 but also the first internal electrodes 4. Thus, as shown in FIG. 7B, an area 37 having no electroconductive paste applied therein is formed, in a cut-shape, in the electroconductive paste film 36 for forming the second internal electrode 5. Moreover, as shown in FIG. 7A, an area 38 having no electroconductive paste applied therein is formed, in a cut-shape, in the electroconductive paste film 35 for forming the first internal electrode 4.

In the other respects, the fourth preferred embodiment is substantially the same as the third preferred embodiment. Thus, the description is not repeated.

Figure 8:
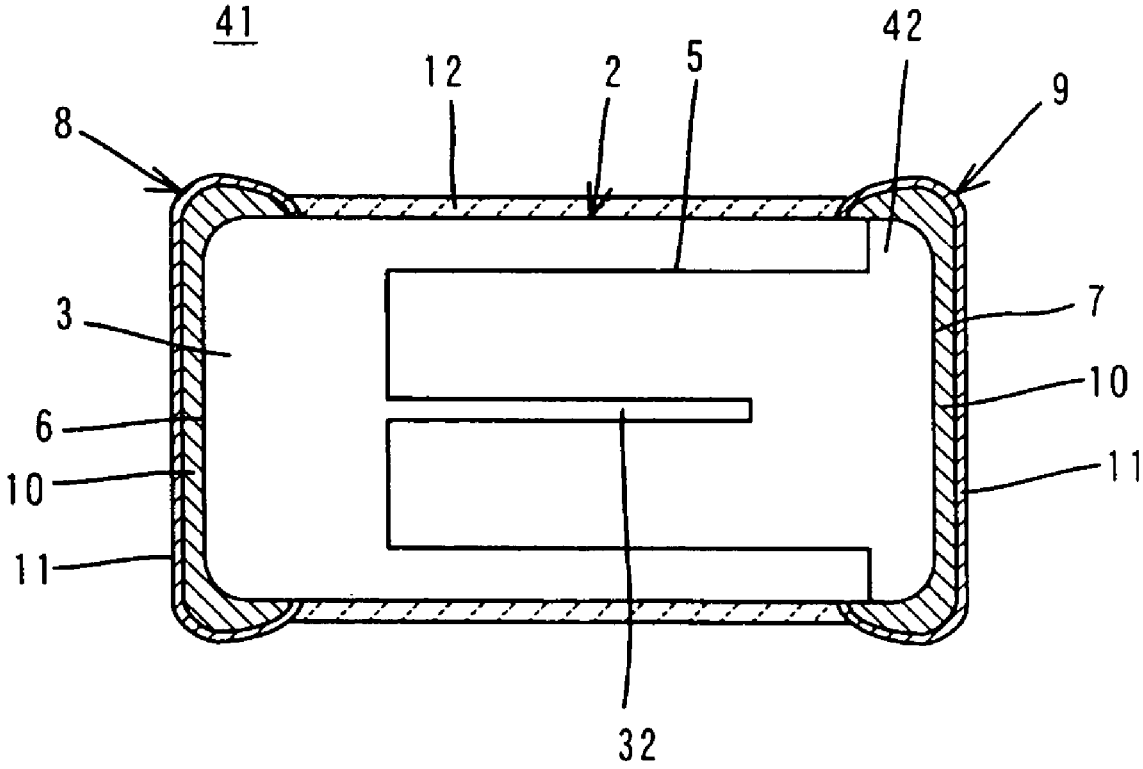
FIG. 8 is a cross sectional plan view of a positive temperature coefficient thermistor according to a fifth preferred embodiment taken along a plane passing through a second internal electrode.

FIG. 8 illustrates a fourth preferred embodiment of the present invention. A positive temperature coefficient thermistor 41 shown in FIG. 8 preferably includes many elements equivalent to those of the positive temperature coefficient thermistor 31 shown in FIG. 5. Thus, in FIG. 8, the elements equivalent to those shown in FIG. 5 are designated by the same reference numerals. The description of common elements is not repeated. FIG. 8 is a cross-sectional plan view of the positive temperature coefficient, taken along a plane passing through the second internal electrode 5.

The positive temperature coefficient thermistor 41 according to the fifth preferred embodiment of the present invention has the following features.

In particular, connecting end portions 42, each having a large width, are formed in the second internal electrodes 5. The connecting end portions 42 are provided for electrical connection to the second external electrode 9. Thereby, the contact area between each second internal electrode 5 and the second external electrode 9 can be increased. Thus, the electrodes 5 and 9 can be electrically connected to each other with high stability. The variation of the electric resistance can be inhibited. The second internal electrode 5 is shown in FIG. 8. Also, the first internal electrode 4 may have the same configuration as described above.

The configuration shown in FIG. 6 may be also used in the first, second and fourth preferred embodiments.

Hereinafter, examples will be described to ascertain the operation and effects of various preferred embodiments of the present invention.

EXAMPLE 1

In Example 1, an example of the first preferred embodiment described with reference to the FIGS. 1, 2A, and 2B is evaluated.

First, powders of $BaCO_3$, $TiO_2$ and $Sm_2O_3$ were prepared. These powdery raw materials were mixed so as to form $(Ba_{0.9998}Sm_{0.0002})TiO_3$.

Subsequently, refined water was added to the produced mixed powder, crushed with stirring for 10 hours, dried, and calcined at a temperature of 1000° C. for 2 hours.

Thereafter, to the calcined powder, an organic binder, a dispersant, and water were added and mixed with zirconia balls for several hours. The produced slurry was formed into a green sheet with a thickness of about 30 μm.

Subsequently, electroconductive paste including nickel as an electroconductive component was applied onto the green sheet by screen-printing, and was dried. Thus, the green sheet having an electroconductive paste film for forming the internal electrode was prepared. A substantially circular perforation with a diameter of about 0.2 mm, for example, for forming the perforation 18 as shown in FIG. 2A was formed in predetermined green sheets having the electroconductive paste films formed thereon.

Then, plural green sheets having the electroconductive paste films formed as described above were laminated to each other. To the upper and lower sides of the formed laminate, green sheets for protection having no electroconductive paste films were laminated. Then, the sheets were press-bonded and cut into a predetermined size. Thus, chip-shaped green laminates were formed.

For Sample 1, the green sheets having the perforations formed as described above were positioned in the approximate center in the lamination direction of the portion of the laminate where the electroconductive paste films were arranged. For Sample 2, the green sheets having the perforations were positioned in the outermost portion in the lamination direction of the portion of the laminate where the electroconductive paste films were arranged. For sample 3, the green sheets having the perforations were positioned in the approximate center and in the outermost portion in the lamination direction of the portion of the laminate where the electroconductive paste films were arranged. Moreover, for Sample 4, only the green sheets having no perforations were laminated.

Thereafter, each green laminate was degreased at about 350° C. in the atmosphere, and fired for about 2 hours at about 1300° C. in a reducing atmosphere containing approximately 3% of $H_2/N_2$. Thus, the sintered laminate was produced. The perforations provided for the green sheets became cavities in the laminates of the samples 1 to 3.

After the sintering, each laminate was abraded with a barrel using abrasion-media, so that the angular and ridge potions of the laminate were rounded. Thereafter, the laminate was heat-treated for re-oxidation.

Thereafter, to form external electrodes, a Cr layer, a Ni—Cu layer, and an Ag layer were formed on both end surfaces of the laminate by sputtering in that order. Thus, an ohmic electrode layer was formed. Then, a plating layer of solder was formed on the ohmic electrode layer.

Thus, positive temperature coefficient thermistors with a size viewed in the plan of approximately 2.0 mm×1.2 mm and a resistance of about 0.3 Ω as Samples 1 to 4 were formed.

Thereafter, for each of the positive temperature coefficient thermistors of Samples 1 to 4, 20 sample pieces were tested on the withstand voltage property thereof. For the withstand voltage test, each positive temperature coefficient thermistor of Samples 1 to 4 were sandwiched between terminals connected to a DC source. A voltage of about 20 V was applied to a sample piece for 1 minute, and then, was increased by about 2 V and applied for approximately 1 minute. This process was repeated. That is, the withstand voltage test was carried out in which the voltage was increased by a step-up method. The voltage was increased until the sample piece of the positive temperature coefficient thermistor was broken. The voltage measured immediately before the breakdown was taken as a withstand voltage.

Table 1 shows the average, the maximum, the minimum and the standard deviation of the withstand voltage.

TABLE 1

| Sample No. | Withstand voltage | | | |
|---|---|---|---|---|
| | Average | Maximum | Minimum | Standard Deviation |
| 1 | 36.1 | 38 | 32 | 1.7 |
| 2 | 31.0 | 36 | 28 | 2.0 |
| 3 | 29.8 | 34 | 28 | 1.9 |
| 4 | 30.0 | 34 | 26 | 2.9 |

Referring to Table 1, for Samples 2 and 3 in which each cavity was formed in the portion excluding the approximate center in the lamination direction of the portion of the laminate where the internal electrodes were arranged, the withstand voltage properties were nearly on the same level as that of Sample 4 in which no cavity was formed. On the other hand, for Sample 1 in which the cavities were formed in the approximate center in the lamination direction of the portion of the laminate where the internal electrodes were arranged, the withstand voltages remarkably increased. As a result, it can be understood that the withstand voltage property is greatly improved by preventing a hot spot from occurring in the center in the lamination direction of the portion of the laminate where the internal electrodes are arranged as described above.

In the above-described Examples, the positions of the cavities in the lamination direction of the laminates are compared to each other. It can be easily estimated that, regarding the positions of cavities along the direction that is substantially perpendicular to the lamination direction of the laminates, hot spots can be more effectively prevented by formation of the cavities in the approximate centers of the portions of the laminates where the internal electrodes overlap each other, compared to the case in which the cavities are formed in the portions excluding the approximate centers thereof.

EXAMPLE 2

In Example 2, examples of the second preferred embodiment described with reference to FIG. 3 and FIGS. 4A and 4B are evaluated.

Green sheets were formed in the same manner and conditions as those in Example 1.

Subsequently, electroconductive paste including nickel as an electroconductive component was applied onto the green sheets by screen-printing to form electroconductive paste films. In this case, as an area corresponding to the area 27 having no electroconductive paste applied thereon as shown in FIGS. 4A and 4B, formed in the approximate center of the portion of the laminate where the internal electrodes overlapped, a substantially circular area with a diameter of about 0.1 mm was formed for Sample 11, a substantially circular area with a diameter of about 0.2 mm was formed for Sample 12, and a substantially circular area with a diameter of about 0.5 mm was formed for Sample 14. For Sample 14, an area having no electroconductive paste applied thereon was not formed, that is, an electroconductive paste film was evenly formed on the whole of the sample piece.

For Samples 11 to 14, the size of the portion of the laminate where the internal electrodes overlapped each other, which was measured after sintering, was approximately 1.6 mm×0.8 mm.

Subsequently, for Samples 11 to 14, the plural green sheets having the electroconductive paste films formed as described above were laminated to each other. To the upper and lower sides of the formed laminate, green sheets for protection having no electroconductive paste films formed thereon were laminated. Chip-shaped green laminates were formed according to the same manner and conditions as those used in Example 1. The chip-shaped green laminates were degreased, abraded with a barrel, and heat-treated for re-oxidation. Thereafter, an ohmic electrode and a plating layer for forming an external electrode were formed.

Thus, positive temperature coefficient thermistors with a size viewed in the plan of approximately 2.0 mm×1.2 mm and a resistance of about 0.5 Ω for Samples 11 to 13 were formed. For Samples 11 to 13, openings were provided in the internal electrodes in the areas thereof where the electroconductive paste was not applied.

For Samples 11 to 14, the withstand voltage test was carried out in the same manner and conditions as those used in Example 1.

Table 2 shows the average, the maximum, the minimum, and the standard deviation of the withstand voltage.

TABLE 2

| | Withstand voltage | | | |
|---|---|---|---|---|
| Sample No. | Average | Maximum | Minimum | Standard Deviation |
| 11 | 38.4 | 40 | 36 | 1.7 |
| 12 | 43.3 | 46 | 38 | 2.0 |
| 13 | 49.1 | 56 | 32 | 5.6 |
| 14 | 32.1 | 36 | 28 | 2.7 |

Referring to Table 2, for Samples 11 to 13 in which the areas having not electroconductive paste formed thereon were provided in the electroconductive paste films, and thereby, the openings were provided in the internal electrodes, the withstand voltage was improved compared to Sample 14 in which such an opening was not provided. Thus, it is understood that the withstand voltage can be enhanced by preventing a hot spot from occurring in the approximate center in the lamination direction of the portion of the laminate as described above.

Samples 11 to 13 are compared below. The openings of Samples 11, 12, and 13 become larger in that order. The averages of the withstand voltage measurements becomes larger as the sizes of the openings are increased. However, since the current capacities of the internal electrodes decrease, which leads to the breakdown, the variation of the withstand voltage measurements become larger. Accordingly, it is seen that, preferably, the sizes of openings to be formed in the internal electrodes are determined considering the variation of the current capacities of the internal electrodes, that is, the variation of the withstand voltage.

EXAMPLE 3

In Example 3, the third preferred embodiment described with reference to FIG. 5 and FIGS. 6A and 6B is evaluated.

Green sheets were formed in the same manner and conditions as those in Example 1.

Subsequently, electroconductive paste including nickel as an electroconductive component was applied onto the green sheets by screen-printing to form electroconductive paste films. In this case, green sheets having the electroconductive paste film 35 evenly formed thereon, as shown in FIG. 6A, were produced, and also, green sheets each having an area (about 0.1 mm in width×about 1.7 mm in length) not having the electroconductive paste applied thereon in the approximate center of the portion of the laminate where the internal electrodes overlapped each other, as shown in FIG. 6B, were produced.

Subsequently, the plural green sheets having the electroconductive paste films formed as shown in FIG. 6A, and the plural green sheets 34 having the electroconductive paste films 36 formed as shown in FIG. 6B were alternately laminated. To the upper and lower sides of the formed laminate, green sheets for protection having no electroconductive paste films formed thereon were laminated. Chip-shaped green laminates were formed according to the same manner and conditions as those used in Example 1. The chip-shaped green laminates were degreased, abraded with a barrel, and heat-treated for re-oxidation. Thereafter, an ohmic electrode and a plating layer for forming an external electrode were formed.

Thus, a positive temperature coefficient thermistor with a size viewed in the plan of approximately 2.0 mm×1.2 mm and a resistance of about 0.5 Ω for Sample 21 was formed. In this positive temperature coefficient thermistor, a cut portion was formed, which was caused by the area not having the electroconductive paste applied thereon of the internal electrode.

Thereafter, for the positive temperature coefficient thermistor of Sample 21, the withstand voltage test was carried out in the same manner and conditions as those used in Example 1.

Table 3 shows the average, the maximum, the minimum, and the standard deviation of the withstand voltage obtained by this withstand voltage test. Regarding Sample 4, prepared according to Example 1, that is, having no cut portions formed in the internal electrodes, the average, the maximum, the minimum, and the standard deviation of the withstand voltage shown in Table 1 are repeated in Table 3 for convenient comparison.

TABLE 3

| Sample No. | Withstand voltage | | | |
|---|---|---|---|---|
| | Average | Maximum | Minimum | Standard Deviation |
| 21 | 44.4 | 46 | 40 | 1.84 |
| 4 | 30.0 | 34 | 26 | 2.9 |

As seen in Table 3, for Sample 21 in which the areas having no electroconductive paste applied therein were formed in the electroconductive paste films, and thereby, the cut portions were provided in the internal electrodes, the withstand voltage property was improved compared to that of Example 4 which was not provided with such cut portions formed. Thus, the withstand voltage test has identified that the withstand voltage property can be improved by preventing a hot spot from occurring in the approximate center of the laminate and also by providing the cut portions to divide the heating portions into two portions so that the quantity of generated heat is reduced.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the invention which fall within the true spirit and scope of the invention.

What is claimed is:

1. A positive temperature coefficient thermistor comprising:

a laminate including a plurality of thermistor layers stacked in a lamination direction and having a positive resistance temperature coefficient;

first and second external electrodes disposed at different positions on an outer surface of the laminate;

a plurality of first internal electrodes and a plurality of second internal electrodes arranged so as to extend along predetermined interfaces between the plurality of thermistor layers inside of the laminate and so as to be electrically connected to the first external electrode and the second external electrode, respectively, the first internal electrodes and the second internal electrodes being arranged alternately in the lamination direction so that a portion of the first internal electrodes and a portion of the second internal electrodes overlap each other while sandwiching the thermistor layers therebetween; and at least one non-heating portion, which is not heated when a voltage is applied between the first and second internal electrodes, being located at an approximate center along a direction that is substantially perpendicular to the lamination direction of the portion of the laminate where the first and the second internal electrodes are arranged and at feast in an approximate center in the lamination direction thereof; wherein the at least one non-heating portion includes a cavity provided in at least one of the thermistor layers;

the cavity is disposed at least in the approximate center of the laminate in the lamination direction; and the cavity does not extend entirely through the laminate.

2. A positive temperature coefficient thermistor comprising:

a laminate including a plurality of thermistor layers stacked in a lamination direction and having a positive resistance temperature coefficient;

first and second external electrodes disposed at different positions on an outer surface of the laminate;

a plurality of first internal electrodes and a plurality of second internal electrodes arranged to extend along predetermined interfaces between the plurality of thermistor layers inside of the laminate and so as to be electrically connected to the first external electrode and the second external electrode, respectively, the first internal electrodes and the second internal electrodes being arranged alternately in the lamination direction so that a portion of the first internal electrodes and a portion of the second internal electrodes overlap each other in the lamination direction while sandwiching the thermistor layers; and at least one cavity being provided in at least one of the thermistor layers in an approximate center along a direction that is substantially perpendicular to the lamination direction of the portion of the laminate where the first and the second internal electrodes overlap each other, the at least one cavity being positioned at least at an approximate center in the longitudinal and width directions of the portion of the laminate where the first and second internal electrodes overlap each other, the at least one cavity being positioned at least at an approximate center in the lamination direction of the portion of the laminate where the first and the second internal electrodes are arranged; wherein the at least one cavity does not extend entirely through the laminate.

3. A positive temperature coefficient thermistor according to claim 2, wherein the at least one cavity is formed so as pass through the thermistor layer in the thickness direction.

4. A positive temperature coefficient thermistor according to claim 2, wherein the internal electrode positioned on one end side of the at least one cavity is provided with an opening connected to the at least one cavity.

5. A positive temperature coefficient thermistor according to claim 2, wherein the at least one cavity has a shape that is one of a vertical column, substantially triangular, substantially rectangular, substantially polygonal, substantially elliptic, and star shaped.

6. A positive temperature coefficient thermistor according to claim 2, further comprising a plurality of cavities formed in the laminated and arranged and aligned at the approximate center along a direction that is substantially perpendicular to the lamination direction of the portion of the laminate where the first and the second internal electrodes overlap each other, and the plurality of cavities being positioned at least at the approximate center in the lamination direction of the portion of the laminate where the first and the second internal electrodes are arranged.

7. A positive temperature coefficient thermistor according to claim 6, wherein each of the plurality of cavities has a shape that is one of a vertical column, substantially triangular, substantially rectangular, substantially polygonal, substantially elliptic, and star shaped.

8. A positive temperature coefficient thermistor comprising:

a laminate induding a plurality of thermistor layers stacked in a lamination direction and having a positive resistance temperature coefficient;

first and second external electrodes disposed at different positions on an outer surface of the laminate; and a plurality of first internal electrodes and a plurality of second internal electrodes arranged so as to extend along predetermined interfaces between the plurality of thermistor layers inside the laminate and so as to be electrically connected to the first external electrode and the second external electrode, respectively, the first internal electrodes and the second internal electrodes being arranged alternately in the lamination direction so that a portion of the first internal electrodes and a portion of the second internal electrodes overlap each other while sandwiching the thermistor layers therebetween, at least one of the first and second internal electrodes which is positioned at least at an approximate center in the lamination direction of the portion of the laminate where the first and second internal electrodes are arranged including a portion thereof that is not provided with the electrode, the portion not provided with the electrode being positioned at least an approximate center along a direction that is substantially perpendicular to the lamination direction of the portion of the laminate where the first and second internal electrodes overlap each other; wherein the portion not provided with the electrode includes an opening provided in the internal electrode;

the opening is positioned at least at the center in the longitudinal and width directions of the laminate; and the size of the opening is at least about 0.1 mm.

9. A positive temperature coefficient thermistor according to claim 8, wherein the portion not provided with the electrode is provided in all of the first electrodes or all of the second internal electrodes.

10. A positive temperature coefficient thermistor according to claim 8, wherein the portion not provided with the electrode is provided in all of the first electrodes and the second internal electrodes.

11. A positive temperature coefficient thermistor comprising:

a laminate including a plurality of thermistor layers stacked in a lamination direction and having a positive resistance temperature coefficient;

first and second external electrodes disposed at different positions on an outer surface of the laminate; and a plurality of first internal electrodes and a plurality of second internal electrodes arranged so as to extend along predetermined interfaces between the plurality of thermistor layers inside the laminate and so as to be electrically connected to the first external electrode and the second external electrode, respectively, the first internal electrodes and the second internal electrodes being arranged alternately in the lamination direction so that a portion of the first internal electrodes and a portion of the second internal electrodes overlap each other while sandwiching the thermistor layers therebetween, at least one of the first and second internal electrodes which is positioned at least at an approximate center in the lamination direction of the portion of the laminate where the first and second internal electrodes are arranged including a portion thereof that is not provided with the electrode, the portion not provided with the electrode being positioned at least an approximate center along a direction that is substantially perpendicular to the lamination direction of the portion of the laminate where the first and second internal electrodes overlap each other; wherein the portion not provided with the electrode includes a cut portion provided in the internal electrode; and the cut portion is positioned at least at the center in the longitudinal and width directions of the laminate.

12. A positive temperature coefficient thermistor according to claim 11, wherein the portion not provided with the electrode is provided in all of the first electrodes or all of the second internal electrodes.

13. A positive temperature coefficient thermistor according to claim 11, wherein the portion not provided with the electrode is provided in all of the first electrodes and the second internal electrodes.

* * * * *